US012672672B2

(12) United States Patent
Asterhed

(10) Patent No.: US 12,672,672 B2
(45) Date of Patent: Jul. 7, 2026

(54) SNUS CONTAINER, A METHOD OF MANUFACTURING A SNUS CONTAINER AND A MOULD

(71) Applicant: SÄVJO PLASTIC AB, Sävsjö (SE)

(72) Inventor: Tommy Asterhed, Sävsjö (SE)

(73) Assignee: Sävjo Plastic AB, Savjo (SE)

( * ) Notice: Subject to any disclaimer, the term of this patent is extended or adjusted under 35 U.S.C. 154(b) by 0 days.

(21) Appl. No.: 18/834,875

(22) PCT Filed: Feb. 9, 2023

(86) PCT No.: PCT/SE2023/050105
§ 371 (c)(1),
(2) Date: Jul. 31, 2024

(87) PCT Pub. No.: WO2023/153987
PCT Pub. Date: Aug. 17, 2023

(65) Prior Publication Data

US 2025/0017264 A1 Jan. 16, 2025

(30) Foreign Application Priority Data

Nov. 2, 2022 (SE) ..... 2250138-1

(51) Int. Cl.
*A24F 23/00* (2006.01)
*B65D 41/17* (2006.01)
*B65D 50/06* (2006.01)

(52) U.S. Cl.
CPC ..... *A24F 23/00* (2013.01); *B65D 41/17* (2013.01); *B65D 50/061* (2013.01)

(58) Field of Classification Search
CPC ..... B65D 41/0471; B65D 2251/065; B65D 50/061; B65D 41/17; B65D 43/0254; B65D 43/0256; A24F 23/00; A24F 23/02
(Continued)

(56) References Cited

U.S. PATENT DOCUMENTS 3,372,834 A * 3/1968 Ayotte ..... B65D 41/17 220/780
3,904,063 A * 9/1975 Hauser ..... B65D 41/17 215/318

(Continued)

FOREIGN PATENT DOCUMENTS

EP 0606978 A1 6/1994
EP 3405050 B1 3/2023

OTHER PUBLICATIONS

International Search Report and Written Opinion for co-pending PCT/EP2022/075117, 12 pp., Jan. 9, 2023.

(Continued)

*Primary Examiner* — Chun Hoi Cheung
(74) *Attorney, Agent, or Firm* — Kagan Binder, PLLC

(57) ABSTRACT

The present disclosure relates to a snus container provided with a locking arrangement comprising a first latch member and a second latch member, wherein a first lid is adapted to be rotatable relative a body about a rotational axis between a first closed position where the first latch member and the second latch member are latched together to axially fix the first lid to the body, and an unlocked position where the first lid is axially displaced relative its first closed position, wherein the locking arrangement is adapted to counteract rotation of the first lid from the first closed position towards the unlocked position until the first lid is rotated to a position where the first latch member is forced to axially dislodge from the second latch member, thereby allowing the first lid to freely rotate to the unlocked position and be releasable from the body. A method for releasing a first lid from a body of a snus container is also disclosed.

15 Claims, 9 Drawing Sheets

(58) Field of Classification Search
USPC ..... 215/318, 295; 220/254.1, 254.7, 254.8; 206/65
See application file for complete search history.

(56) References Cited

U.S. PATENT DOCUMENTS

| | | | | | |
|---|---|---|---|---|---|
| 3,982,651 | A * | 9/1976 | Braun | B65D 41/17 | 220/288 |
| 4,171,057 | A * | 10/1979 | Gach | B65D 50/048 | D24/224 |
| 5,715,960 | A * | 2/1998 | Seymour | B65D 41/17 | 215/318 |
| 6,394,295 | B2 * | 5/2002 | Claude | B65D 41/17 | 215/354 |
| 6,588,615 | B1 * | 7/2003 | Pitassi | B65D 41/17 | 215/318 |
| 7,942,280 | B2 * | 5/2011 | Priebe | B65D 50/046 | 215/217 |
| 8,365,933 | B2 * | 2/2013 | Jackel | B65D 41/17 | 215/331 |
| 12,245,630 | B2 * | 3/2025 | Patel | B65D 43/0254 | |
| 2007/0074984 | A1 * | 4/2007 | Liu | A45C 11/00 | 206/349 |
| 2009/0008391 | A1 | 1/2009 | Bjorkholm | | |
| 2009/0101644 | A1 * | 4/2009 | Maiwald | B65D 47/122 | 220/254.1 |
| 2018/0186521 | A1 * | 7/2018 | Hein | B65D 43/0256 | |
| 2019/0239562 | A1 * | 8/2019 | Beardsall | B65D 43/0212 | |
| 2023/0329334 | A1 * | 10/2023 | Patel | B65D 41/185 | |

OTHER PUBLICATIONS

Swedish Search Report for co-pending SE2151118-3, 3 pp., Mar. 30, 2022.

* cited by examiner

SNUS CONTAINER, A METHOD OF MANUFACTURING A SNUS CONTAINER AND A MOULD

CROSS-REFERENCE TO RELATED APPLICATIONS

This application claims priority to International Application No. PCT/SE2023/050105, filed Feb. 9, 2023, which in turn claims priority from Swedish Patent Application having serial number 2250138-1, filed on Feb. 11, 2022, both of which are incorporated herein by reference in their entireties for all purposes.

TECHNICAL FIELD

The present disclosure relates to a snus container, a method of manufacturing a snus container and a mould, and in particular to a snus container with locking functionality.

BACKGROUND

Snus is generally sold to consumers as packaged snus portions stored in a container with a resealable lid. These containers are conventionally cylindrical in shape and made of a plastic or polymer material.

To keep manufacturing costs low, the containers are typically designed with as thin walls as possible without impairing the functionality of storing snus portions. This typically results in snus containers being relatively flexible in design which introduces risk of failure and risk of the snus containers accidentally opening when in a pocket or in a bag. There is also a risk that these snus containers can be easily pried open by children.

EP3405050 A1 discloses a child resistant snus container provided with a locking arrangement which requires a resiliently flexible tongue to be inwardly deflected from a locked configuration before the lid can be rotated relative the main body of the snus container to an unlocked position before the lid can be detached from the body.

A problem of this design is that it increases the complexity of the snus container which leads to increased manufacturing cost and risk of failure.

It is therefore of interest to provide a snus container with a locking arrangement of a more cost-efficient design.

SUMMARY

It is an object of the present invention to provide an improved solution that alleviates the mentioned drawbacks with present solutions. In particular, a first object of the invention is to provide a snus container comprising a locking arrangement of a more cost-efficient design. This object is solved by the invention as defined in claim 1. A second object of the invention is to provide a two-compartment snus container with a locking arrangement of a more cost-efficient design. This object is solved by the invention as defined in claim 8. A third object is to provide a method of manufacturing a snus container of simple and cost-efficient design. This object is solved by the invention as defined in claim 9. A fourth object is to provide a mould for use in said method. This object is solved by the invention as defined in claim 10.

According to a first aspect of the invention, a snus container is provided. The snus container comprises: a body defining a first compartment; a first lid adapted to be releasably attached to the body to close the first compartment, the snus container further comprising a locking arrangement comprising a first latch member and a second latch member, wherein the first latch member is arranged to a lid side portion of the first lid and the second latch member is arranged to a body side portion of the body, wherein the first lid is adapted to be rotatable relative the body about a rotational axis between a first closed position where the first latch member and the second latch member are latched together to axially fix the first lid to the body, and an unlocked position where the first lid is axially displaced relative its first closed position, wherein the locking arrangement is adapted to counteract rotation of the first lid from the first closed position towards the unlocked position until the first lid is rotated to a position where the first latch member is forced to axially dislodge from the second latch member, thereby allowing the first lid to freely rotate to the unlocked position and be releasable from the body.

An advantage of this snus container is that it is adapted to be unlocked and opened by a single operation, namely by rotating the first lid from the first closed position to the unlocked position. The unlocking of the locking arrangement may thus be causally dependent on the rotation of the first lid relative the body. This removes the necessity to incorporate a locking arrangement of higher complexity. The present snus container is thus simpler in design and thusly benefits from a reduced risk of failure. Moreover, the snus container due to its simple design can be more cost-efficiently manufactured, thereby solving the first object of the invention.

The snus container may comprise a second lid adapted to be releasably attached to the first lid to close a second compartment defined by the first lid.

Used and unused snus portions may be stored in either the first compartment and/or the second compartment. One of the first compartment and the second compartment may be adapted in shape and size to provide a compartment of smaller volume than the other. The smaller compartment may be used to store used snus portions whereas the larger compartment may be used to store unused snus portions or vice versa.

In the following, some of phrases or terms mentioned above are further discussed.

By the locking arrangement being adapted to counteract rotation of the first lid, it may be meant that the locking arrangement may flexibly act against or provide resistance against said rotation that the first lid must overcome in order to successfully rotate from the first closed position to the unlocked position. Said means for counteracting rotation may be primarily provided by the latching force between the first latch member and the second latch member. In other words, a torque of sufficient magnitude must be applied to the first lid so that the latching force between the first latch member and the second latch member is overcome.

By referring to an event or movement being carried out axially, such as axially dislodging, it may be meant that said event or movement is being carried out along a direction substantially parallel to a main axis. Said main axis may be the rotational axis. The direction of the rotational axis may be defined by how the first lid rotates relative the body. Said main axis may be a cylindrical axis in the case the snus container is provided with a substantially cylindrical shape.

By axially fixed, it may mean that the first lid and the body is in a position wherein the locking arrangement hinders axial displacement until the first latch member and the second latch member are forced to be axially dislodged.

Further, when axially fixed, the first lid may be allowed to at least partly rotate relative the body about the rotational axis.

In the following, further optional features of the snus container are discussed.

The snus container may be adapted in size and shape to have a form factor similar to conventional snus containers. The snus container may have a substantially cylindrical shape. The first compartment may have a substantially cylindrical shape also.

The first lid may have a cylindrical structure adapted to be at least partially inserted into the first compartment. The cylindrical structure of the first lid may define a second compartment. The snus container may comprise a second lid adapted to be releasably attached to the first lid to close the second compartment. The snus container may be made from a polymer material. The snus container may be made from a plastic material. Alternatively, the snus container may be made from a material comprising a metal such as aluminum, titanium, etc. One or more of the parts of the snus container may be made from the same material. The body may be made from a polymer material, plastic material or said metal. The first lid may be made from a polymer material, plastic material or said metal. If present, the second lid may be made from a polymer material, plastic material or said metal.

The snus container may be a child resistant snus container. By child resistant snus container, it may be meant that the snus container is adapted so that children under a certain age within a certain time period are typically unable to open the snus container by hand. By typically, it may be meant a majority of children, or that a group of children on average were unable to open the snus container. By certain age, it may be meant children under the age of 10, 9, 8, 7, 6, 5, 4, 3, 2, or 1. By time period, it may be meant under 1 minute, 2 minutes, 5 minutes, 10 minutes, 30 minutes, 1 hour or perpetually. A child may be unable to open the snus container due to the not being able to apply a sufficient strong grip to rotatably open the snus container and/or lacking the coordination required to rotatably open the snus container. A child may be unable to open the snus container due to the not being able to grip the first lid and body accordingly due to their sizes, thereby being unable to rotate them relative each other.

One of the first latch member and the second latch member may be integrally formed in one of the first lid and the body whereas the other of the first latch member and the second latch member is provided as a separate element arranged to the other of the first lid and the body. Preferably, both the first latch member and the second latch member are integrally formed in the first lid and the body respectively. By this, the snus container may be more efficiently manufactured which may reduce manufacturing costs.

The snus container may be adapted so that when the first lid is attached to the body to close the first compartment, the body side portion and the lid side portion extend axially in a parallel manner so that the first latch member and the second latch member latch together to axially fix the first lid to the body.

According to one embodiment, one of the body and the first lid comprises a gripping space edge adapted in shape and size to form a gripping space between the gripping space edge and a surface of the other of the body and the first lid, wherein said gripping space edge is in a position to prevent access to said gripping space when the first lid is in the first closed position and in a position to allow access to said gripping space when the first lid is in the unlocked position. Thus, while axially displacing the first lid from the body by rotating the first lid from the first closed position to the unlocked position, the gripping space may become exposed which enables the first lid to be gripped by a user, thereby facilitating the first lid to be released from the body. Likewise, when the first lid is in the first closed position, the gripping space may be prevented from being accessible so that no gripping edge is provided. As a consequence, the first lid and the body may present a substantially connected outer side which prevents any edge from serving as a gripping edge. This makes it more difficult to forcibly open the snus container while the first lid is in a closed position. The gripping space edge may be arranged to the body and said surface is arranged on the first lid. The gripping space edge may be arranged to the first lid and said surface is arranged on the body. The gripping space may be at least partly bounded by a surface of the gripping space edge and said surface of the body or first lid. The body or the first lid may provide an abutting surface to which the gripping space edge is adapted to abut when the first lid is in in a closed position. Alternatively, the abutting surface is provided by a separate member adapted to be arranged between the body and first lid. The gripping space may also be least partly bounded by the abutting surface. Said surface of the body or first lid and said surface of the gripping space edge may be acutely angled relative each other by an acute angle in any of the intervals of 15°-25°, 25°-35°, 35°-45°, 45°-55°, 55°-65°, or 65°-75°. In one embodiment, said surface is arranged to the body and the gripping space edge is arranged to the first lid. In such a case, said surface of the body may be provided by the body side portion. In one embodiment, said surface is arranged to the first lid and the gripping space edge is arranged to the body. In such a case, said surface of the first lid may be provided by the lid side portion.

According to one embodiment, one of the body and the first lid comprises an engagement element adapted to engage with at least one sloping edge portion provided by the other of the body and the first lid so that when the first lid rotates relative the body from the first closed position to the unlocked position, the engagement element slides along said at least one sloping edge portion, thereby forcing the first lid to displace relative its first closed position so that the first latch member axially dislodges from the second latch member. The first lid may comprise the engagement element and the body may comprise the at least one sloping edge portion. The at least one sloping edge portion may be provided by the body side portion. The first lid may comprise the at least one sloping portion and the body may comprise the engagement element. The at least one sloping edge portion may be angled relative a rotational plane through which the rotational axis intersects at a right angle. The at least one sloping edge portion may be angled to said rotational plane in a curved and smooth manner. The sloping edge portion may comprise a maximally sloping portion which is angled relative said rotational plane by an acute angle within any of the intervals of 1°-5°, 5°-10°, 10°-15°, 15°-20°, or 20°-25°. By such a slope, the slope of the sloping edge portion may provide little or negligible resistance as the engagement element slides along its surface, so as to minimize rotational friction caused by the slope. By this, most of the counteracting force to said rotation is provided by the locking arrangement.

According to one embodiment, the snus container comprises at least one pair of sloping edge portions arranged proximate to each other to form a respective ridge. By this, it may allow the first lid to rotate from a closed position to an unlocked position in either rotational direction. One ridge may preferably comprise a plateau arranged between the sloping edge portions of said ridge. By this, the engagement element may be positioned at a substantially leveled region when in the unlocked position, which may be favorably when removing the first lid from the body. The snus container may comprise one or more ridges. The snus container may comprise one or more engagement elements. Said one or more ridges may be arranged to the body or the first lid. Said one or more engagement elements may be arranged to the body or the first lid.

According to one embodiment, the snus container comprises a plurality of engagement elements adapted to engage with a respective ridges, wherein the respective ridges are preferably arranged symmetrically in the snus container. The first lid may comprise 2, 3, 4, 5 or more engagement elements. The snus container may comprise a similar or different number of ridges. The ridges may be arranged to the body or the first lid in a pattern corresponding to the positions of the engagement elements arranged to the first lid or body respectively when the first lid is releasably attached to the body to close the first compartment. One or more of the engagement elements referenced above may have a rectangular shape and/or may be integrally formed in the first lid. One or more of the ridges referenced above may be integrally formed in the first lid.

According to one embodiment, one of the body and the first lid is made of a first material, and the other of the body and the first lid is made of a second material different from the first material. By providing the body and the first lid in different materials, the friction between the body and the first lid may be reduced. The first material and/or the second material may be selected among materials including: polymer materials such as polypropylene homopolymer, PPH, polypropylene copolymer, PPC, or polypropylene random copolymer, PPR-C; or e.g. porcelain, wood, birch bark, gold, silver, aluminum, copper, pressed paper or plastic. The second lid may be made of the first material, the second material, or a third material different from the first material and the second material. The third material may be selected from the list of materials listed above.

According to one embodiment, the first lid comprises a plurality of support bars. The support bars may be arranged proximate the lid side portion. The support bars may extend radially from a first lid position to a second lid position radially outward from the first lid position. By radially, it may mean a direction radially from a center of the first lid. The center of the first lid may coincide with a point where the rotational axis intersects the first lid. The support bars may enable the first lid to reduce the flexibility of the first lid. Thus, by this, the first lid may be more securely attached to the body to prevent the first lid from being forcibly released from the body when the first lid is in a closed position. The support bars may extend at least partly or wholly along a bottom surface of the first lid. The support bars may extend through an intermediate side portion. The support bars may be integrally formed in the first lid. The plurality of support bars may include 2, 3, 4, 5, 6, 7, 8, 9 or 10 or more support bars. The support bars may be symmetrically arranged about the first lid.

According to one embodiment, the body may comprise a plurality of support structures. The support structures may extend along a side wall of the body in a direction at least partially or substantially parallel to the rotational axis of the snus container. The support structures may be grouped together in a plurality of support structures as a group of support structures. The snus container may comprise a plurality of groups of support structures. Each group of support structures may comprise two, three, four, five, or more support structures. At least one group of support structures may be arranged proximate a ridge of the snus container. The group of support structures may be symmetrically arranged about the body. A support structure may have a bar shape.

According to one embodiment, the body and the first lid may each comprise an orientation indicator, thereby forming a pair of orientation indicators. The pair of orientation indicators may be arranged on an outside of the snus container and axially align when the first lid is in a closed position. Said closed position may be a second closed position different from the first closed position. Said closed position may be the first closed position. By this pair of orientation indicators, a user may be provided with information how the first lid is oriented rotationally relative the body. The snus container may comprise a plurality of pairs of orientation indicators arranged accordingly to the body and the first lid and adapted to align as mentioned above. The orientation markers may be structurally defined or may be markings provided on the respective surfaces of the body and first lid.

According to one embodiment, one of the first latch member and the second latch member is a protrusion and the other of the first latch member and the second latch member is a recess adapted in shape and size to receive said protrusion. The first latch member may be a protrusion and the second latch member may be a recess. The first latch member may be a recess and the second latch member may be a protrusion. Irrespective of which first latch member and second latch member is provided as a protrusion or a recess, the recess is adapted in shape and size to receive the protrusion in a latching manner. As an example, the protrusion may have a substantially semi-cylindrical shape and extend longitudinally in a circumferential direction of the snus container. The recess may be adapted with a corresponding shape so that it is enabled to receive the protrusion in a latching manner. The protrusion and recess may be adapted to extend in a circumferential direction in a corresponding manner, either wholly along the circumferential of the snus container or in a plurality of separate segments.

According to one embodiment, the locking arrangement is adapted to provide a first interface between the first latch member and the second latch member which is acutely angled relative a rotational plane of the snus container. The first interface may be defined by a first interface surface of the first latch member and a first interface surface of the second latch member which face and/or abut the first interface surface of the first latch member when the first latch member and the second latch member latch together. The first interface may be located relative the first/second latch member on a side that is closer to the bottom of the body. Alternatively, the first interface is located relative the first/second latch member on a side that is closer to a top surface of first lid. The locking arrangement may be adapted to provide a second interface between the first latch member and the second latch member which is acutely angled relative a rotational plane of the snus container. The second interface may be defined by a second interface surface of the first latch member and a second interface surface of the second latch member which face and/or abut the second interface surface of the first latch member when the first latch member and the second latch member latch together. The second interface may be located on a substantially opposite side of the first/second latch element as the first interface. An acute angle referenced for the first and/or second interface may be in any of the intervals of 5°-10°, 10°-15°, 15°-20°, 20°-25°, 25°-30°, 30°-35°, 35°-40°, 45°-50°, 50°-55°, 55°-60°, 60°-65°, 65°-70°, 70°-75°, 75°-80°, or 80°-85°.

According to one embodiment, the first lid defines a second compartment, wherein the snus container further comprises a second lid adapted to be releasably attached to the first lid to close the second compartment. By this, the snus container may store used and unused snus portions in separate compartments.

The first lid and the second lid may be adapted so that the second lid is adapted to be received in a recessed manner in the first lid so that a portion of the first lid extends at least partially up from the first lid along an outer edge of the second lid. This may prevent the outer edge of the second lid from being gripped. The snus container may comprise a gripping region provided as a recessed region of the first lid where a user is provided access to an edge of the second lid. A user may thus grip the edge and pull off the second lid to allow access into the second compartment.

A method of manufacturing a snus container according to the first aspect of any embodiments thereof is provided. The method comprises the steps of: providing a mould defining a plurality of mould cavities corresponding to parts at least the body and the first lid of the snus container; injecting a material into each of the plurality of mould cavities a material, and once solidified, ejecting the snus container from the mould, wherein preferably one of the body and first lid is made of a first material, and the other of the body and the first lid is made of a second material different from the first material.

According to a second aspect of the invention, a mould is provided. The mould is adapted in shape and size to define a plurality of cavities corresponding to at least the body and the first lid of the snus container according to the first aspect or any embodiments thereof. The mould may also define a cavity corresponding to the second lid of the snus container according to the first aspect or any embodiments thereof. The mould may comprise separate members each defining at least one of said cavities. Each separate mould member may be adapted to receive a different injected material, such as PPH, PPC, PPR-C. Separate mould member may each define a cavity for the body, the first lid and optionally the second lid respectively.

According to a third aspect of the invention, a method for releasing a first lid from a body of a snus container is provided. The method comprises the steps of: rotate the first lid relative the body from a first closed position, engaging an engagement element with a sloping edge portion, disengaging a first latch member from a second latch member, wherein the body comprises the first latch member and the first lid comprises the second latch member, and rotate the first lid relative the body into an unlocked position.

The body may comprise the sloping edge portion and the first lid may comprise the engagement element. In an alternative embodiment, the first lid may comprise the sloping edge portion and the body may comprise the engagement element.

Further, the step of engaging the engagement element with the sloping edge portion may comprise sliding the engagement element onto the sloping edge portion.

The sloping edge portion may be a portion of a ridge.

The step of disengaging the first latch member and the second latch member may comprise that the first latch member and the second latch member are axially dislodged from each other.

The step of rotating the first lid relative the body into the unlocked position may comprise sliding the engagement element onto a plateau of the ridge.

The method may further comprise a further step of rotating that precedes the first step of rotating, the step may comprise: rotate the first lid relative the body from a second closed position into the first closed position, wherein the first lid remains axially fixed to the body.

The invention is defined by the appended independent claims, with embodiments being set forth in the appended dependent claims, in the following description and in the drawings.

BRIEF DESCRIPTION OF THE DRAWINGS

The invention will in the following be described in more detail with reference to the enclosed drawings, wherein.

DESCRIPTION OF EMBODIMENTS

Figure 1:
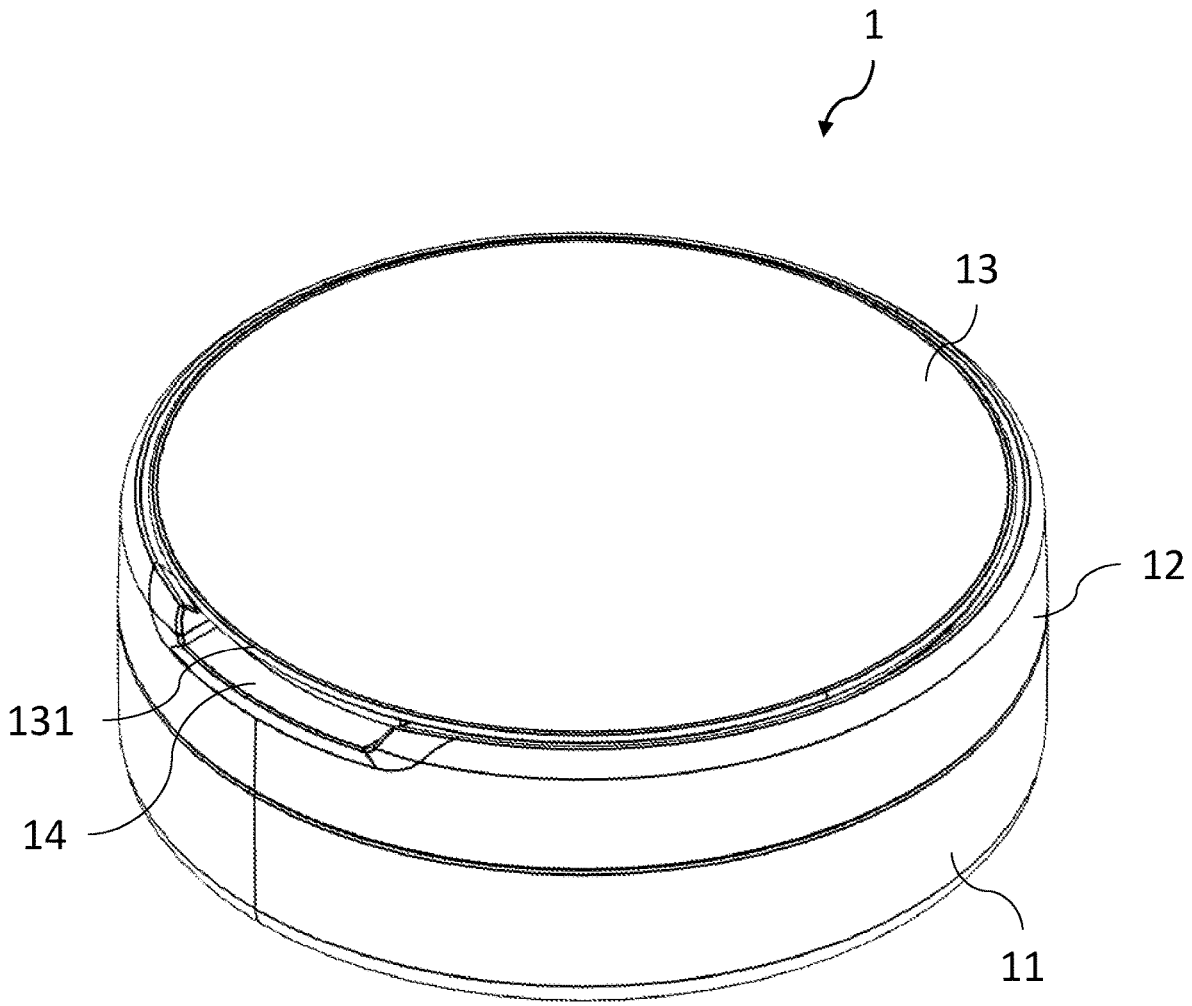
FIG. 1 shows a perspective view of a snus container according to one embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

A general embodiment of the snus container will now be discussed. Although the general embodiment is discussed in reference to FIGS. 1-7, features shown to be comprised in the preferred embodiments illustrated in FIGS. 1-7 but not discussed in the following may be optional. In the general embodiment, the snus container 1 may comprise a body 11 defining a first compartment 110. The snus container 1 may comprise a first lid 12 adapted to be releasably attached to the body 11 to close the first compartment 110. The snus container 1 may comprise a locking arrangement 112, 122 for locking the first lid 12 to the body 11. The locking arrangement 112, 122 may comprise a first latch member 122 and a second latch member 112. The first latch member 122 may be arranged to the first lid 12. The first latch member 122 may be arranged to a lid side portion 121 of the first lid 12. The second latch member 112 may be arranged to the body 11. The second latch member 122 may be arranged to a body side portion 111 of the body 11. The first lid 12 may be adapted to be rotatable relative the body 11 about a rotational axis R between a first closed position P1 where the first latch member 122 and the second latch member 112 are latched together, and an unlocked position P2 where the first lid 12 is releasable from the body 11. When the first latch member 122 and the second latch member 112 are latched together, the first lid 12 may be axially fixed to the body 11. When the first lid 12 is in the unlocked position P2, the first latch member 122 and the second latch member 112 may be disengaged or axially dislodged from one another. When the first lid 12 is in the unlocked position P2, the first lid 12 may be axially displaced relative its first closed position P1. The first lid 12 may be freely rotatable to the unlocked position P2 when the first latch member 122 and the second latch member 112 are disengaged or axially dislodged from one another. The locking arrangement 112, 122 may be adapted to counteract rotation of the first lid 12 from the first closed position P1 towards the unlocked position P2 until the first lid 12 is rotated to a position where the first latch member 122 is forced to disengage or axially dislodge from the second latch member 112, thereby allowing the first lid 12 to freely rotate to the unlocked position P2 and be releasable from the body 11.

The snus container 1 may thus provide a simple and cost-efficient design. More particularly, by coupling the process of unlocking the locking arrangement 112, 122 to the rotation of the first lid 12 relative the body 11, a more intuitive solution is provided, which does not rely on a separately operated and complex locking arrangement 112, 122. Rather, the first lid 12 may be axially fixed to the body 11 be means of a structurally simpler locking arrangement 112, 122 comprising two latching members 112, 122 which can be adapted in shape and size to provide a desired latching effect that a user must overcome in order to unlock the snus container 1 so that it may be opened. Due to this simple design, the snus container 1 allows a wide variety in how it may be adapted to achieve a desired design purpose, such as providing a child resistant snus container.

One of the first latch member 122 and the second latch member 112 may be integrally formed in one of the first lid 12 and the body 11 whereas the other of the first latch member 122 and the second latch member 112 is provided as a separate element arranged to the other of the first lid 12 and the body 11. Preferably, both the first latch member 122 and the second latch member 112 are integrally formed in the first lid 12 and the body 11 respectively. By this, the snus container 1 may be more efficiently manufactured which may reduce manufacturing costs. Alternatively, both the first latch member 122 and the second latch member 112 may be provided as separate elements arranged to the first lid 12 and the body 11, respectively.

One of the body 11 and first lid 12 may be made of polypropylene homopolymer, PPH, and the other of the body 11 and the first lid 12 may be made of polypropylene copolymer, PPC. By this, the friction between the body 11 and the first lid 12 may be particularly reduced. The body 11 may be made of PPH or PPC. The first lid 12 may be made of PPH or PPC. Alternatively, polypropylene random copolymer, PPR-C may be used instead of PPH or PPC in the body 11 or the first lid 12. The snus container may comprise a second lid 13 adapted to releasably attach to the first lid 12 to close a second compartment defined by the first lid 12. The second lid 13 may be made of PPH, PPC, or PPR-C. The body 11 may be made of a first material and the first lid 12 may be made of a second material different from the first material. The second lid 13 may be made of the first material, the second material, or a third material different from the first material and the second material.

Preferred embodiments illustrated in the figures will now be discussed in more detail.

FIG. 1 shows one embodiment of the invention wherein the snus container 1 comprises a generally cylindrical shape much like conventional snus containers. The snus container 1 comprises a body 11, a first lid 12 and a second lid 13. The first lid 12 is releasably attached to the body 11 to close a first compartment defined by the body 11. The second lid 13 is releasably attached to the first lid 12 to close a second compartment defined by the first lid 12. The snus container 1 comprises a gripping region 14 provided as a recessed region of the first lid 12 where a user is provided access to an edge 131 of the second lid 13. A user may thus grip the edge 131 and pull off the second lid 13 to allow access into the second compartment. In order to access the first compartment, the first lid 12 is rotated from a first closed position to an unlocked position, which rotation forces a locking arrangement of the snus container 1 to unlock. Said unlocking may involve overcoming a latching force provided by a first latch member latched together with a second latch member which axially dislodges the first latch member from the second latch member from one another. This may allow the first lid 12 to be freely rotatable to the unlocked position where it may be removed from the body 11 to allow access to the first compartment.

Figure 2:
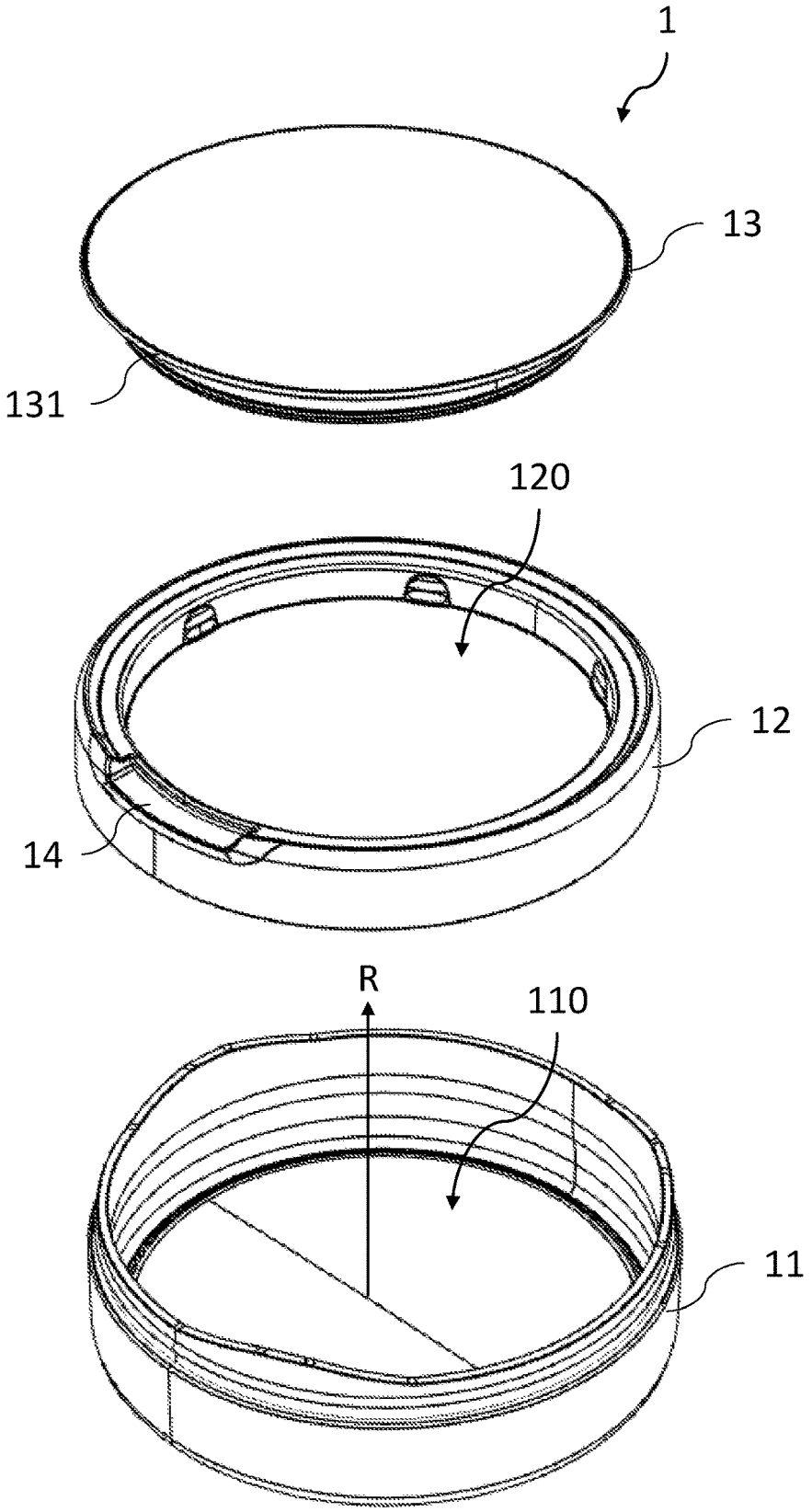
FIG. 2 shows an exploded view of a snus container according to one embodiment of the invention.

FIG. 2 shows an exploded view of the snus container 1 according to one embodiment of the invention. The snus container 1 comprises a first compartment 110 defined by a body 11 and a second compartment 120 defined by a first lid 12. Used and unused snus portions may be stored in either the first compartment 110 and/or the second compartment 120. One of the first compartment 110 and the second compartment 120 may be adapted in shape and size to provide a compartment of smaller volume than the other. The smaller compartment may be used to store used snus portions whereas the larger compartment may be used to store unused snus portions or vice versa. The first compartment 110 may be larger than the second compartment 120 or vice versa. The first compartment 110 may have a substantially cylindrical shape as illustrated in FIG. 2 and extend along a cylindrical axis. The second compartment 120 may have a substantially cylindrical shape as illustrated in FIG. 2 and extend along a cylindrical axis. The first lid 12 and the body 11 may be adapted so that the cylindrical axes of their respective compartments are aligned. The first lid 12 may be rotatable about a rotational axis R relative the body 11 between the first closed position and the unlocked position. The snus container 1 may be adapted so that the rotational axis R is aligned with the cylindrical axes of the respective first and second compartments 110, 120.

The snus container 1 shown in FIG. 2 further comprises a second lid 13. The first lid 12 and the second lid 13 may be adapted so that the second lid 13 is adapted to be received in a recessed manner in the first lid 12 so that a portion of the first lid 12 extends at least partially up from the first lid 12 along an outer edge 131 of the second lid 13. This may prevent the outer edge 131 of the second lid 13 from being gripped. The first lid 12 may comprise a gripping recess 14 which enables access to a portion of said outer edge 131 of the second lid 13, allowing it to be gripped. This may enable removal of the second lid 13 from the first lid 12.

Figure 3:
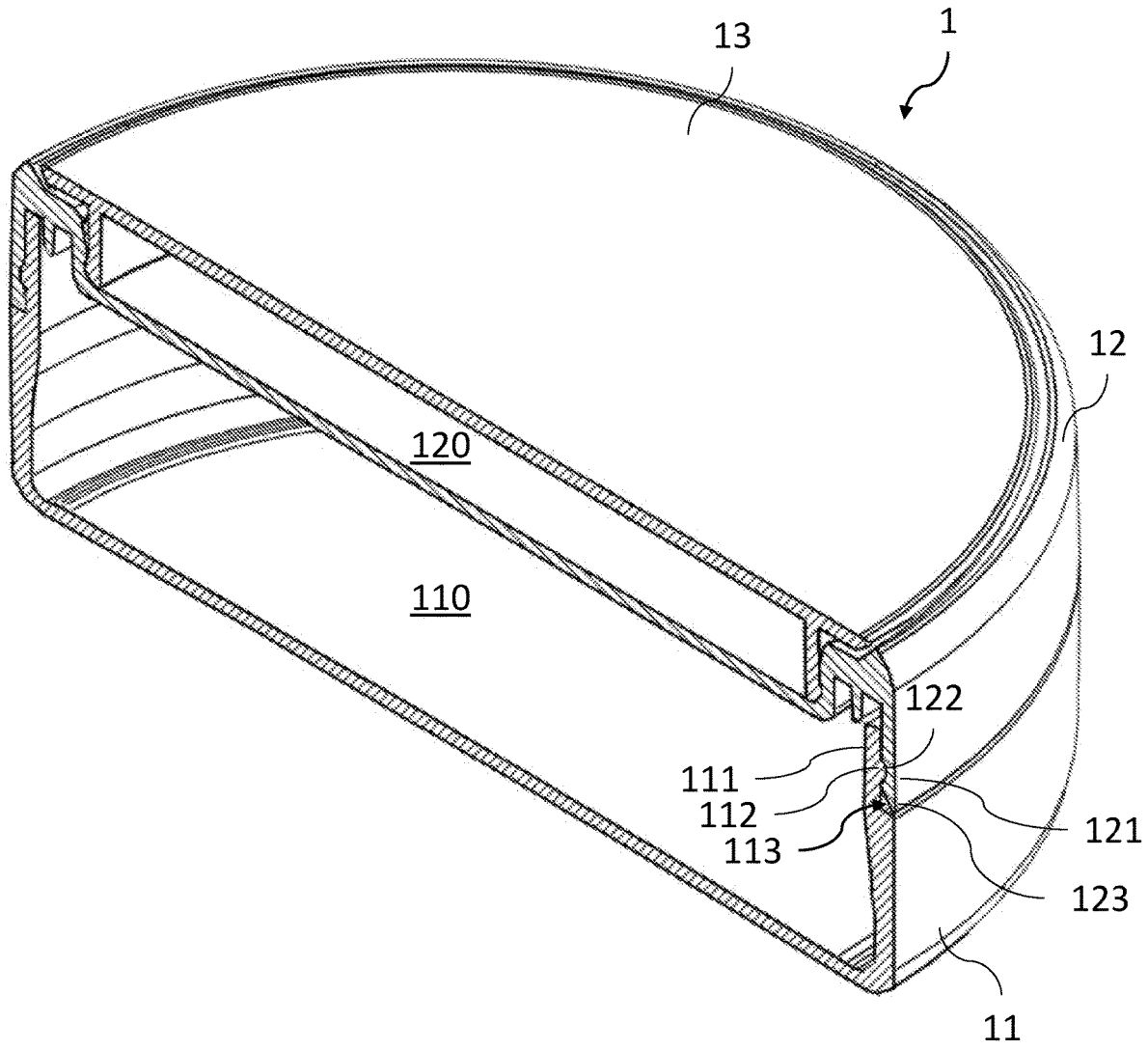
FIG. 3 shows a perspective cross-sectional view of a snus container according to one embodiment of the invention.

FIG. 3 shows a perspective cross-sectional view of a snus container 1 according to one embodiment of the invention. The snus container 1 comprises a body 11 defining a first compartment 110 and a first lid 12 adapted to be releasably attached to the body 11 to close the first compartment 110. The snus container 1 comprises a second lid 13 adapted to be releasably attached to the first lid 12 to close a second compartment 120 defined by the first lid 12. The snus container 1 is adapted with a substantially cylindrical shape and the cross section is a plane intersecting the rotational axis R and extending along the rotational axis R. The snus container 1 further comprises a locking arrangement 112, 122. The locking arrangement 112, 122 comprises a first latch member 122 arranged to a lid side portion 121 of the first lid 12 and a second latch member 112 arranged to a body side portion 111 of the body 11. The first latch member 122 may be integrally formed in the first lid 12. The second latch member 112 may be integrally formed in the body 11. The snus container 1 may be adapted so that when the first lid 12 is attached to the body 11 to close the first compartment 110, the body side portion 111 and the lid side portion 121 extend axially in a parallel manner so that the first latch member 122 and the second latch member 112 latch together to axially fix the first lid 12 to the body 11. In the embodiment depicted in FIG. 3, the first latch member 122 is provided as a recess 122 in the first lid 12 and the second latch member 112 is provided as a protrusion in the body 11, thereby enabling the first latch member 122 and the second latch member 112 to latch accordingly in a tight fit as indicated in FIG. 3. As an alternative embodiment, the first latch member 122 may be provided as a protrusion and the second latch member 112 is provided as a recess. Irrespective of which first latch member 122 and second latch member 112 is provided as a protrusion or a recess, the recess is adapted in shape and size to receive the protrusion in a latching manner. As an example, the protrusion may have a substantially semi-cylindrical shape and extend longitudinally in a circumferential direction of the snus container 1. The recess may be adapted with a corresponding shape so that it is enabled to receive the protrusion in a latching manner. The protrusion and recess may be adapted to extend in a circumferential direction in a corresponding manner, either wholly along the circumferential of the snus container or in a plurality of separate segments.

The first lid 12 and the body 11 may be adapted in shape and size so that their respective outer side surfaces are substantially aligned with one another, as indicated in FIG. 3. By this, the snus container 1 may reduce the number of available gripping regions a user may interact with for the purpose of forcibly open the snus container 1 while the first lid 12 is in a closed position.

The second lid 13 may be adapted to releasably attach to the first lid 12 by means of a latching mechanism. The latching mechanism may comprise a first latch element arranged to or provided by the second lid 13 and a second latch element arranged to or provided by the first lid 12. The first latch element and the second latch element of the latching mechanism may be a protrusion and a recess adapted to receive said protrusion or vice versa. In the embodiment show in FIG. 3, the first latch element is a protrusion, and the second latch element is a recess, which together form the latching mechanism adapted to retain the second lid 13 to the first lid 12 in a closed position. The second lid 13 may be formed by an at least partially flexible material that enables it to flexibly be inserted or removed from the first lid 12.

Figure 4A:
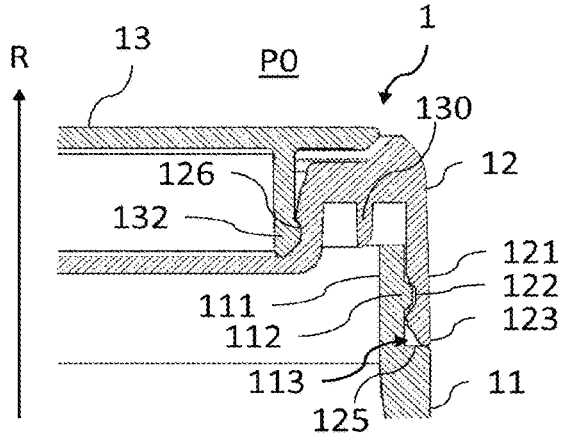
FIGS. 4A-4C show cross-sectional views of a snus container according to one embodiment of the invention when the first lid is in the respective first and second closed position and the unlocked position.
Figure 4B:
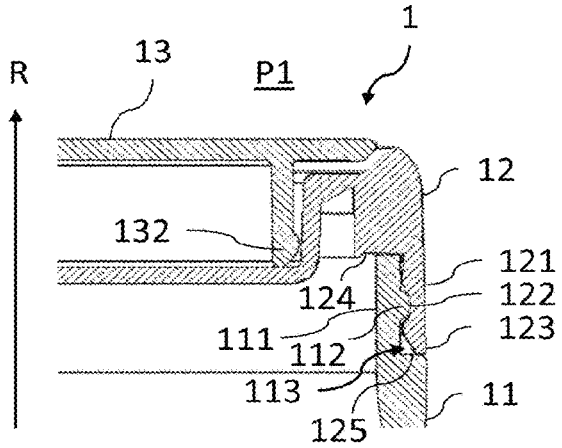
Figure 4C:
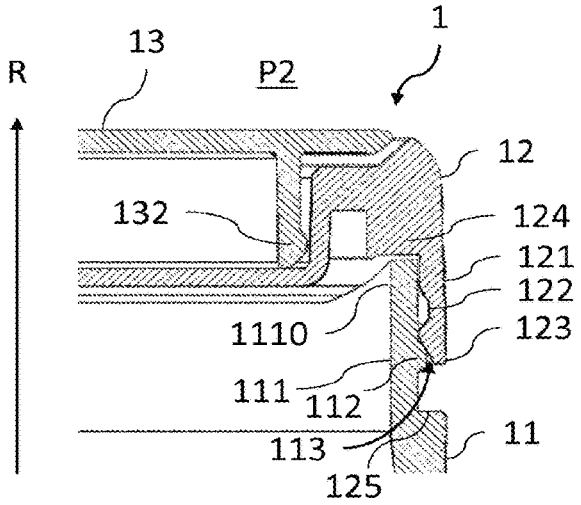

FIG. 4A-4C illustrate a cross sectional view of the snus container 1 according to one embodiment of the invention. The snus container 1 comprises a body 11 defining a first compartment and a first lid 12 adapted to releasably attach to the body 11 to close the second compartment. The snus container 1 comprises a second lid 13 adapted to releasably attach to the first lid 12 to close a second compartment defined by the first lid 12. The first lid 12 is adapted to be rotatable relative the body 11 along the rotational axis R between a first closed position P1 and an unlocked position P2. These positions are illustrated in FIGS. 4B and 4C respectively. In the first closed position P1, the first lid 12 is axially fixed to the body 11 by means of a locking arrangement 112, 122 comprising a first latch member 122 and a second latch member 112. In the unlocked position P2, the first lid 12 is axially displaced relative the first closed position P1 so that the first latch member 122 and the second latch member 112 have been axially dislodged. The snus container 1 may be further adapted so that the first lid 12 is rotatable relative the body 11 between the first closed position P1 and a second closed position P0, during which rotation the first lid 12 remains axially fixed to the body 11 by means of the locking arrangement 112, 122. By allowing the first lid 12 to be rotatable relative the body 11 while being axially fixed thereto, it may allow the first lid 12 to be releasably attached to the body 11 irrespective of the first lids 12 rotational orientation relative the body 11. Thus, it may facilitate closing the first compartment of the snus container 1.

The snus container 1 may further be adapted so that the first lid 12 comprises a gripping space edge 123 adapted in shape and size to form a gripping space 113 between the gripping space edge 123 and the body side portion 111, wherein said gripping space edge 123 is in a position to prevent access to said gripping space 113 when the first lid 12 is in the first closed position P1 and in a position to allow access to said gripping space 113 when the first lid 12 is in the unlocked position P2. Thus, while axially displacing the first lid 12 from the body 11 by rotating the first lid 12 from the first closed position P1 to the unlocked position P2, the gripping space may become exposed which enables the first lid 12 to be gripped by a user (see FIG. 4C), thereby facilitating the first lid 12 to be released from the body 11. Likewise, when the first lid 12 is in the first closed position P1, the gripping space 113 may be prevented from being accessible so that no gripping edge is provided. As a consequence, the first lid 12 and the body 11 may present a substantially connected outer side which prevents any edge from serving as a gripping edge (see FIG. 4A, 4B). When the first lid 12 is in first closed position P1 or in the second closed position P0, the first lid 12 and the body 11 may be radially flush so as to present an even surface to avoid enablement of the gripping space 113. This makes it more difficult to forcibly open the snus container 1 while the first lid 12 is in a closed position P0, P1. The gripping space 113 may be at least partly bounded by a surface of the gripping space edge 123 and a surface of the body side portion 111. The body 11 may provide an abutting surface 125 to which the gripping space edge 123 is adapted to abut when the first lid 12 is in in a closed position. Alternatively, the abutting surface 125 is provided by a separate member adapted to be arranged between the body 11 and the gripping space edge 123. The gripping space 113 may also be least partly bounded by the abutting surface 125. Said surface of the body side portion 111 and said surface of the gripping space edge 123 may be acutely angled relative each other. The acute angle between said surface of the body side portion 111 and said surface of the gripping space edge 123 may be in the interval of 15° to 75°. In FIG. 4A-4C, the snus container 1 is illustrated with said surface of the body side portion 111 being angled to said surface of the gripping space edge 123 by an acute angle of approximately 30°.

The body side portion 111 may comprise a ridge 1110 comprising at least one sloping edge portion. The first lid 12 may comprise an engagement element 124 adapted to engage with said at least one sloping edge portion such that when the first lid 12 rotates relative the body 11 from the first closed position P1 to the unlocked position P2, the engagement element 124 slides along said at least one sloping edge portion, thereby forcing the first lid 12 to displace relative its first closed position P1 so that the first latch member 122 axially dislodges from the second latch member 112. The at least one sloping edge portion may be angled relative a plane through which the rotational axis R intersects at a right angle in a curved and smooth manner. The sloping edge portion may comprise a maximally sloping portion which is angled relative said plane by an acute angle within the interval of 1° and 25°. By such a slope, the slope of the sloping edge portion may provide little resistance as the engagement element 124 slides along its surface, so that most of the counteracting force is provided by the locking arrangement 112, 122.

The second lid 13 may be adapted to releasably attach to the first lid 12 by means of a latching mechanism 126, 132. The latching mechanism 126, 132 may comprise a first latch element 132 arranged to or provided by the second lid 13 and a second latch element 126 arranged to or provided by the first lid 12. The first latch element 132 and the second latch element 126 of the latching mechanism 126, 132 may be a protrusion and a recess adapted to receive said protrusion or vice versa. In the embodiment show in FIG. 3, the first latch element 132 is a protrusion, and the second latch element 126 is a recess, which together form the latching mechanism 126, 132 adapted to retain the second lid 13 to the first lid 12 in a closed position. In the embodiment shown in FIGS. 4A-4C, the second latch element 126 extends only partially in a circumferential direction, which is why it is not shown in FIGS. 4B and 4C. The second latch element 126 may comprise two portions arranged on opposite sides of the second compartment. The first latch element 132 may extend fully in a circumferential direction or partly so as to match the positions of the second latch element 126 when the second lid 13 is releasably attached to the first lid 12 to close the second compartment. The second lid 13 may be formed by an at least partially flexible material that enables it to flexibly be inserted or removed from the first lid 12.

Figure 5A:
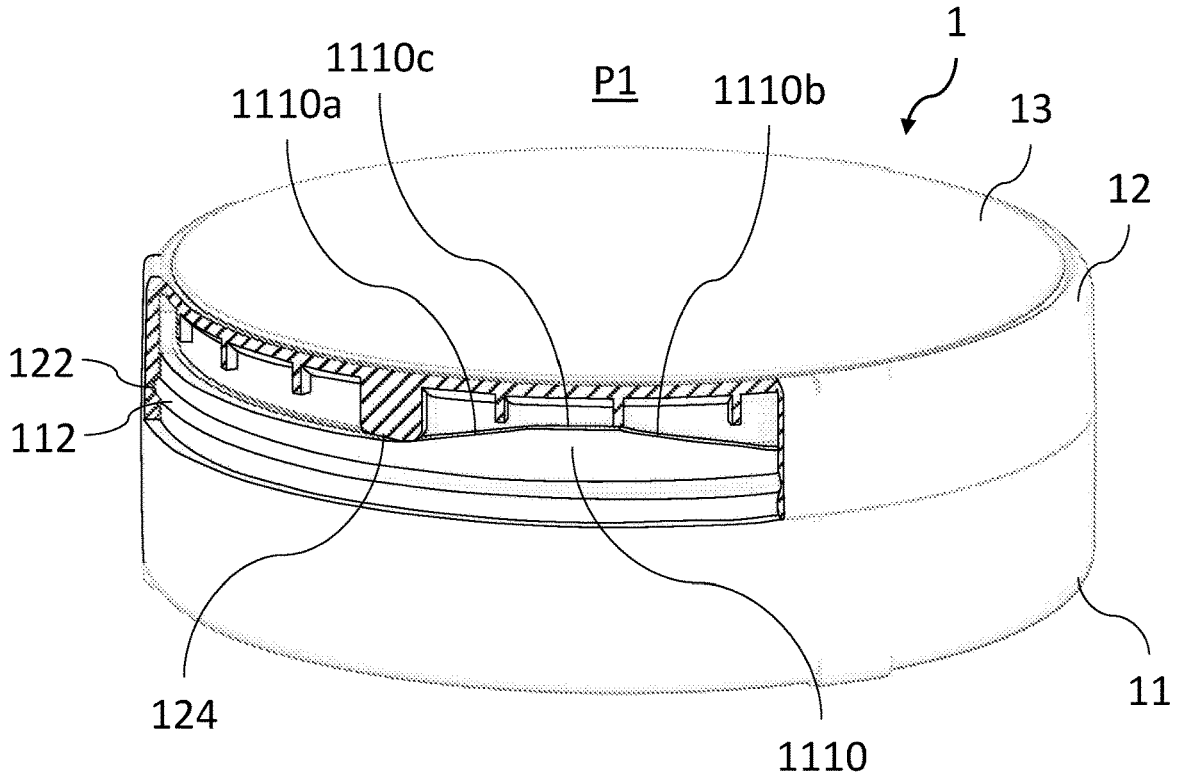
FIGS. 5A-5B show perspective views of a snus container according to one embodiment of the invention where a portion of the first lid has been omitted from view to more clearly illustrate the snus container when the first lid is moved from the second closed position to the unlocked position.
Figure 5B:
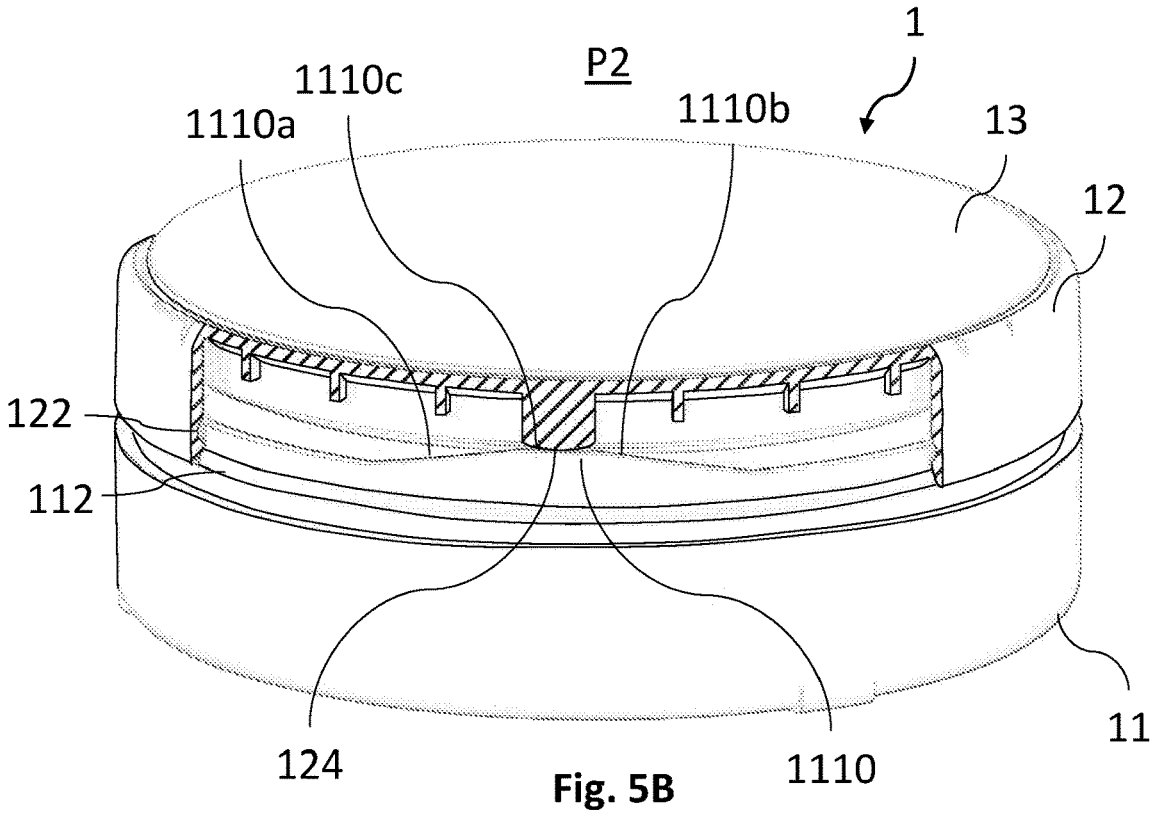

FIGS. 5A and 5B show perspective views of the snus container 1 according to one embodiment of the invention. The snus container 1 comprises a body 11 defining a first compartment and a first lid 12 adapted to be releasably attached to the body 11 to close the first compartment. The first lid 12 is adapted to be rotatable relative the body 11 about a rotational axis between a first closed position P1 and an unlocked position P2 where the first lid 12 is freely releasable from the body 11 so that the first compartment is accessible. When the first lid 12 is in the unlocked position P2, it has been axially displaced relative its first closed position P1. FIG. 5A shows the snus container 1 when the first lid 12 is in the first closed position P1 and FIG. 5B shows the snus container 1 when the first lid 12 is in the unlocked position P2. Moreover, in both FIGS. 5A and 5B, a portion of the first lid 12 has been omitted from view in order to show the functionality of how the snus container 1 according to one embodiment enables the first lid 12 to displace itself relative the body 11 when rotated from the first closed position P1 to the unlocked position P2.

The first lid 12 comprises an engagement element 124 adapted to engage with at least one sloping edge portion 1110*a*, 1110*b* provided by the body side portion 111 so that when the first lid 12 rotates relative the body 11 from the first closed position P1 to the unlocked position P2, the engagement element 124 slides along said at least one sloping edge portion 1110*a*, 1110*b*, thereby forcing the first lid 12 to axially displace relative its first closed position P1 so that the first latch member 122 axially dislodges from the second latch member 112. In the embodiment shown in FIGS. 5A-5B, the body 11 is provided with a pair of sloping edge portions 1110*a*, 1110*b* arranged proximate to each other to form a respective ridge 1110. By this, the first lid 12 may be rotatable relative the body 11 in any direction in order to move the first lid 12 to an unlocked position P2. The ridge 1110 further comprises a plateau 1110*c* arranged between the sloping edge portions 1110*a*, 1110*b* of said ridge 1110. By this, the engagement element 124 may be positioned at a substantially leveled region when in the unlocked position P2, which may be favorably when removing the first lid 12 from the body 11. The ridge or ridges 1110 may alternatively be arranged to or provided by the first lid 12 while the engagement element or engagement elements 124 are arranged to or provided by the body 11.

The snus container 1 further comprises a locking arrangement 122, 112 comprising a first latch member 122 arranged to the first lid 12 and a second latch member 112 arranged to the body 11. When the first lid 12 is in a closed position P0, P1, the first latch member 122 and the second latch member 112 are latch together to axially fix the first lid 12 to the body 11. When the first lid 12 rotates from a closed position to the unlocked position, the locking arrangement 112, 122 counteracts said rotation by means of the latching force provided by the first latch member 122 and the second latch member 112 when latched together. However, when the first lid 12 is forced to rotate against this latching force a portion of the way between the first closed position P1 and the unlocked position P2, the engagement element 124 slides along one of the sloping edge portions, thereby forcing the first lid 12 to displace relative its closed position P1, by which movement the first latch member 122 is forced to axially dislodge from the second latch member 112, thereby enabling the first lid 12 to freely rotate to the unlocked position P2.

According to one embodiment, the locking arrangement is adapted so as to provide an interface between the first latch element 122 and the second latch element 112 which is acutely angled relative a rotational plane of the snus container 1. By rotational plane, it may be meant a plane through which the rotational axis intersects at a right angle. By this acutely angled interface, it may facilitate the first latch member 122 to dislodge from the second latch member 112 when the first lid 12 rotates to a position between the first closed position P1 and the unlocked position P2.

Figure 6A:
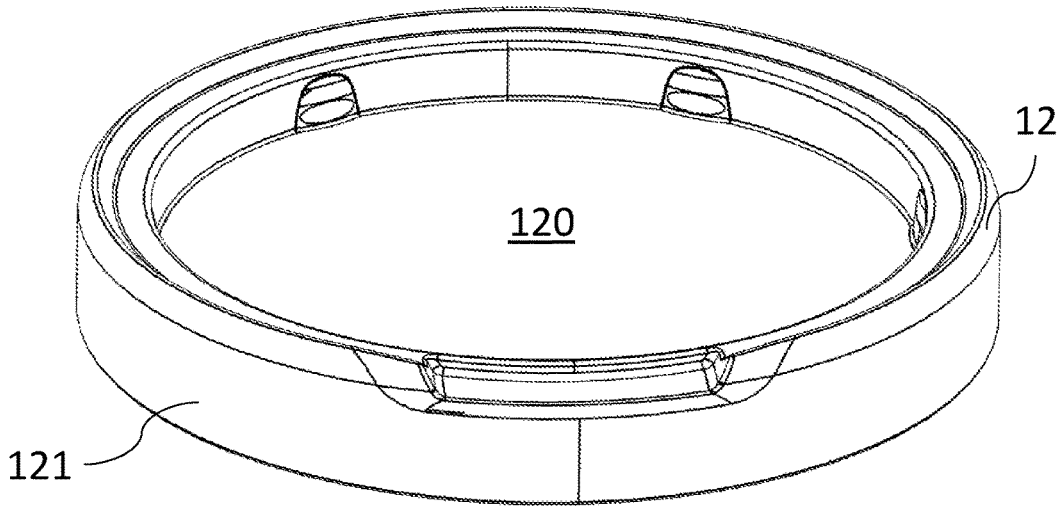
FIGS. 6A-6B show a perspective view and a bottom view of the first lid of a snus container according to one embodiment of the invention.
Figure 6B:
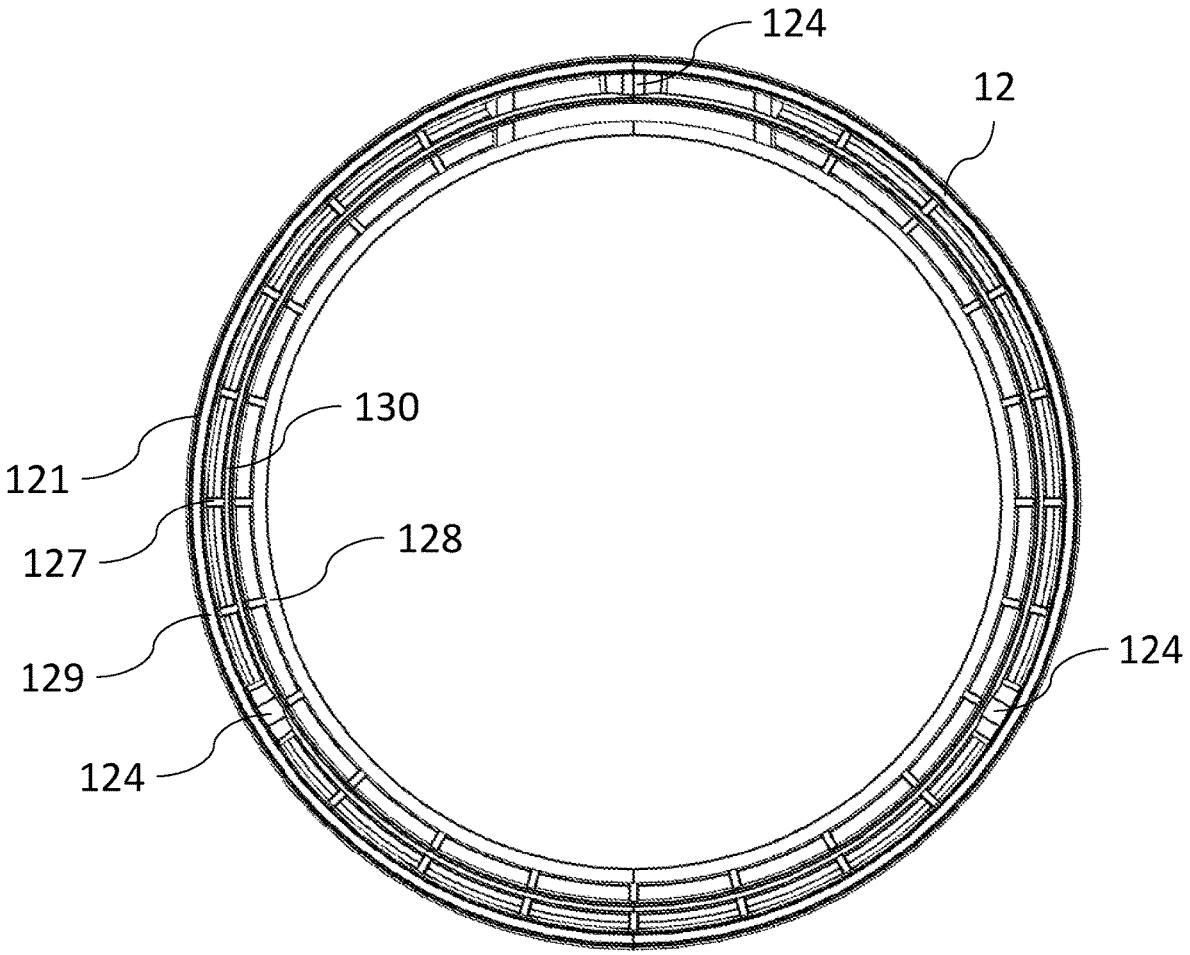
Figure 7:
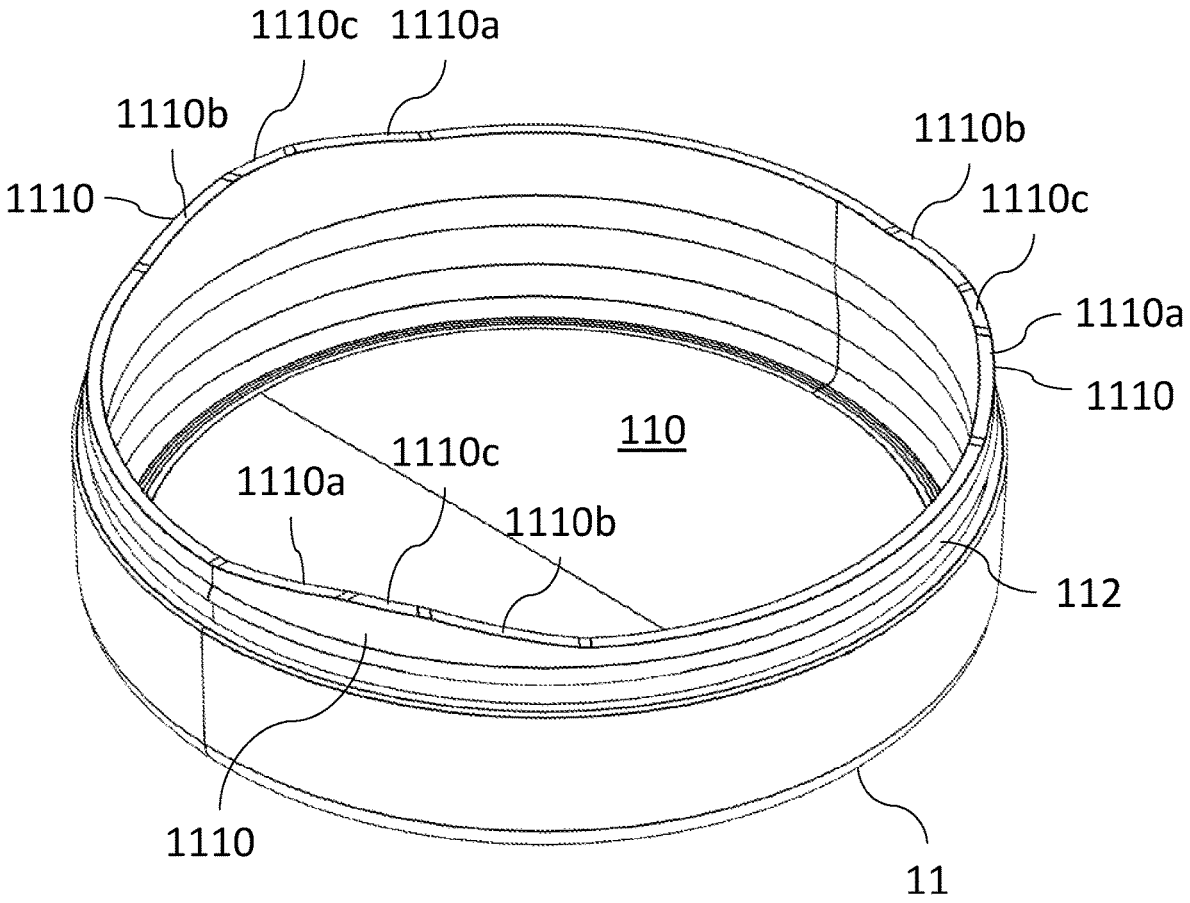
FIG. 7 shows a perspective view of a body of a snus container according to one embodiment of the invention.

In one embodiment, the snus container 1 comprises a plurality of engagement elements 124 adapted to engage with a respective ridge 1110 of the body 11. The respective ridges 1110 may preferably be arranged symmetrically along the body side portion 111. FIGS. 6A and 6B show the first lid 120 according to one embodiment, a perspective view and a bottom view respectively, wherein said first lid 12 comprises three engagement elements 124 arranged symmetrically along the lid side portion in a circumferential direction. Preferably, the body side portion 111 will provide an identical number of ridges 1110, in this case three, which are arranged symmetrically about the body side portion 111, see FIG. 7. The first lid 12 is not limited to comprising three engagement elements 124, but may alternatively comprise 1, 2, 4, 5, or more engagement elements 124. The body 11 may comprise a similar or different number of ridges 1110. A snus container 1 with a first lid 12 comprising a fewer number of engagement elements 124 may be cheaper to produce while a snus container 1 with a first lid 12 comprising more engagement elements 124 may distribute forces more evenly, thereby increasing the snus containers 1 longevity.

According to one embodiment, the first lid 12 comprises a plurality of support bars 127 arranged proximate the gripping space edge 121 of the first lid 12. The support bars 127 may extend radially from a first lid position 128 to a second lid position 129 radially outward from the first lid position. By radially, it may mean a direction radially from a center of the first lid 12. The center of the first lid may coincide with a point where the rotational axis intersects the first lid 12. The support bars 127 may enable the first lid 12 to reduce the flexibility of the first lid 12. Thus, by this, the first lid 12 may be more securely attached to the body to prevent the first lid 12 from being forcibly released from the body 11 when the first lid 12 is in a closed position. The support bars 127 may extend at least partly or wholly along a bottom surface of the first lid. The support bars may extend through an intermediate side portion 130. The support bars 127 may be integrally formed in the first lid 12. The plurality of support bars 127 may include 2, 3, 4, 5, 6, 7, 8, 9 or 10 or more support bars. The support bars 127 may be symmetrically arranged about the first lid 12.

Figure 8A:
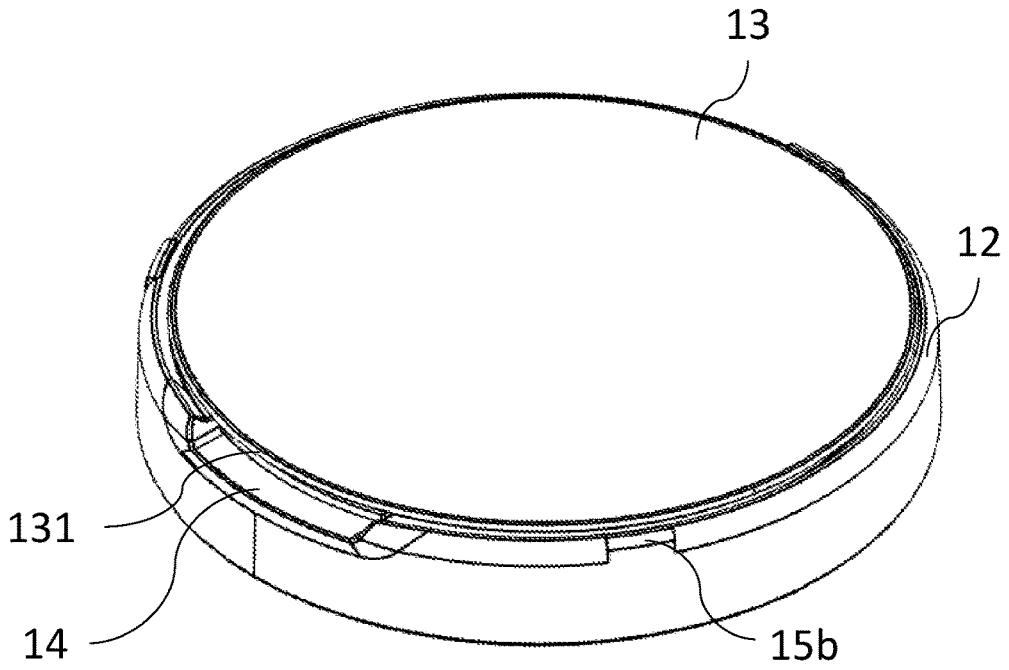
FIG. 8A shows a perspective view of a first lid of a snus container according to one embodiment of the invention.
Figure 8B:
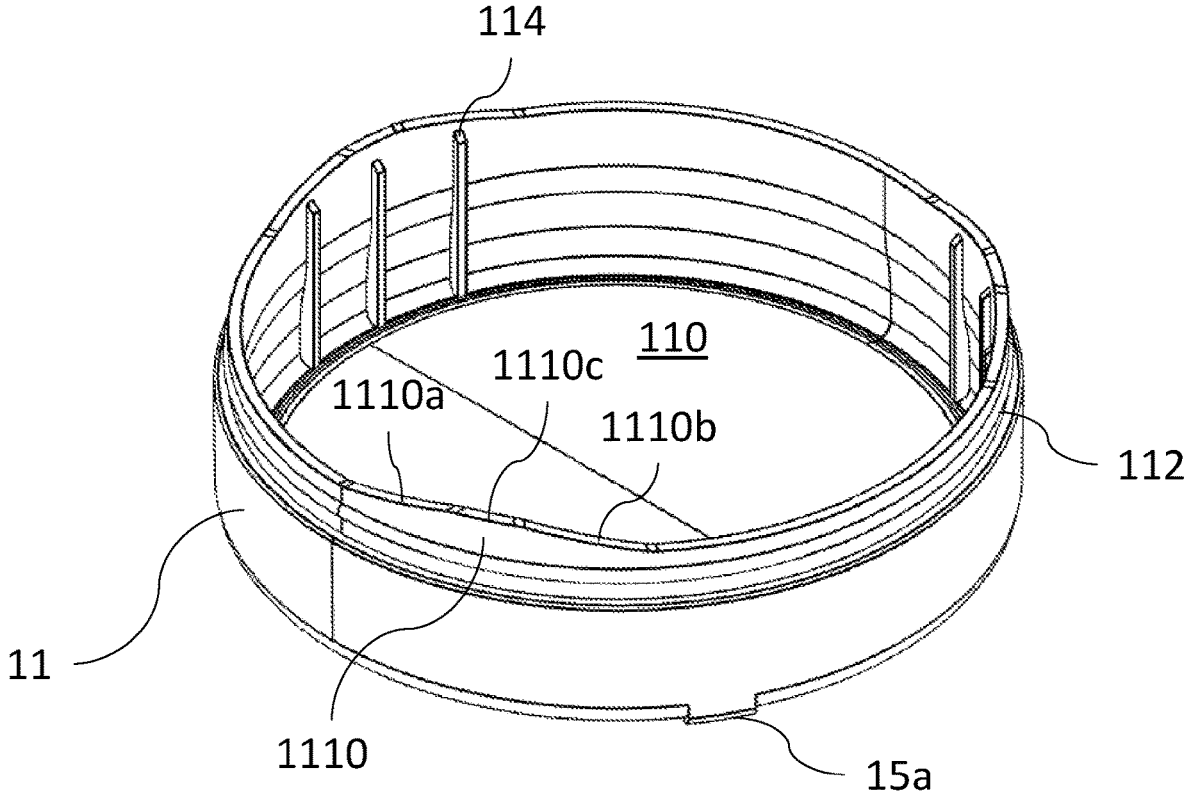
FIG. 8B shows a perspective view of a body of a snus container according to one embodiment of the invention.

FIG. 8A show the first lid 12 according to one embodiment and FIG. 8B show the body 11 according to one embodiment. The body 11 and the first lid 12 may each comprise orientation indicators 15*a*, 15*b* which are adapted to axially align in matching pairs to indicate to a user whenever the first lid 12 is in a closed position. Said closed position may be said second closed position P0 or the first closed position P1. The orientation indicators may be structurally defined, see e.g. FIGS. 8A-8B.

According to one embodiment, the body 11 may comprise a plurality of support structures 114. The support structures 114 may extend along a side wall of the body 11 in a direction at least partially or substantially parallel to the rotational axis R of the snus container 1. The support structures 114 may be grouped together as a plurality of support structures 114 to form a group of support structures 114. The snus container 1 may comprise a plurality of groups of support structures 114. Each group of support structures 114 may comprise two, three, four, five, or more support structures 114. At least one group of support structures 114 may be arranged proximate a ridge 1110 of the snus container 1. The group of support structures 114 may be symmetrically arranged about the body 11, preferably each proximate to a respective ridge 1110. A support structure may have a bar shape. By these support structures, it may increase the rigidity of the body 11 to prevent it from flexing too much in a manner that allows the first lid 12 to be removed from the body 11 when the first lid 12 is in a closed position.

Figure 9A:
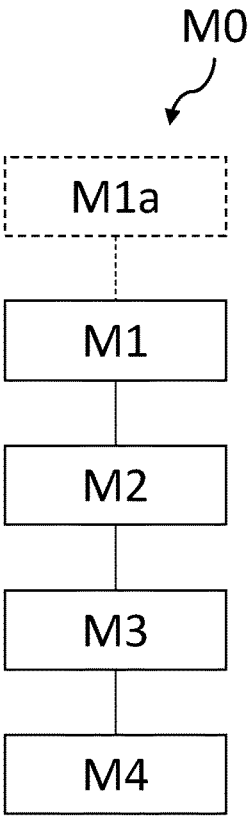
FIG. 9A-9B show a respective flow chart of a method for releasing a first lid from a body of a snus container and of a method of manufacturing a snus container according to one embodiment of the invention.

FIG. 9A shows a flow chart of a method M0 for releasing a first lid 12 from a body 11 of a snus container 1 according to one embodiment of the invention. The method comprising the steps of: rotate M1 the first lid 12 relative the body 11 from a first closed position P1, engaging M2 an engagement element 124 with a sloping edge portion 1110*a*, 1110*b*, disengaging M3 a first latch member 122 from a second latch member 112, wherein the body 11 comprises the first latch member 112 and the first lid 12 comprises the second latch member 122, and rotate M4 the first lid 12 relative the body 11 into an unlocked position P2.

The body 11 may comprise the sloping edge portion 1110*a*, 1110*b* and the first lid 12 comprises the engagement element 124.

The step of engaging M2 the engagement element 124 with the sloping edge portion 1110*a*, 1110*b* may comprise sliding the engagement element 124 onto the sloping edge portion 1110*a*, 1110*b*. The sloping edge portion 1110*a*, 1110*b* may be a portion of a ridge 1110.

The step of disengaging M3 the first latch member 122 and the second latch member 112 may comprise that the first latch member 122 and the second latch member 112 are axially dislodged from each other.

The step of rotating M4 the first lid 12 relative the body 11 into the unlocked position P2 may comprise sliding the engagement element 124 onto a plateau 1110*c* of the ridge 1110.

The method may comprise a step M1*a* that precedes the step of rotating M1, the step M1*a* comprises: rotate M1*a* the first lid 12 relative the body 11 from a second closed position P0 into the first closed position P1, wherein the first lid 12 remains axially fixed to the body 11.

Figure 9B:
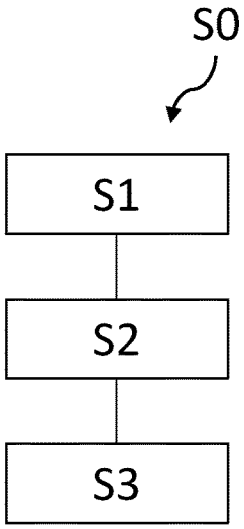

FIG. 9B shows a flow chart of a method S0 of manufacturing a snus container 1 according to one embodiment of the invention. The method S0 comprises the steps of: providing S1 a mould 100 defining a plurality of mould cavities 1021, 1022, 1023 corresponding to parts at least the body 11 and the first lid 12 of the snus container 1; injecting S2 a material into each of the plurality of mould cavities 1021, 1022, 1023 a material, and once solidified, ejecting S3 the snus container 1 from the mould 100, wherein preferably one of the body 11 and first lid 12 is made of a first material and the other of the body 11 and the first lid 12 is made of a second material different from the first material. The method S0 may also include manufacturing a second lid 13 adapted to be releasably attached to the first lid 12 to close a second compartment defined by the first lid 12. The body 11, the first lid 12 and the optional second lid 13 may be provided in accordance with any of the embodiments or contemplated variations previously discussed. As first material or second material, PPH, PPC, or PPR-C may be used or any other materials herein mentioned.

Figure 10:
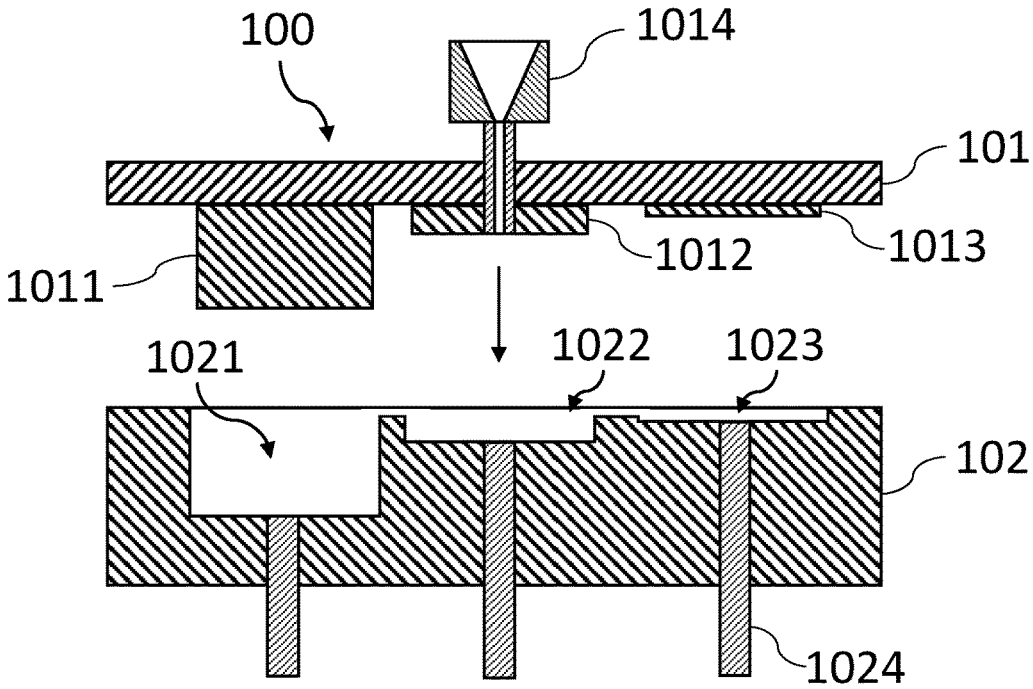
FIG. 10 shows a cross sectional side view of a mould used during the method of manufacturing a snus container according to one embodiment of the invention.

FIG. 10 shows a cross-sectional view of a mould 100 used during the method S0 of manufacturing a snus container 1 according to one embodiment of the invention. The mould 100 comprises an upper mould part 101 and a lower mould part 102. The lower mould part 102 is adapted in shape and size to define a plurality of recesses 1021, 1022, 1023 adapted to receive protrusions 1011, 1012, 1013 respectively of the upper mould part 101 when the upper mould part 101 and the lower mould part 102 are pressed together. The recesses and protrusions together define mould cavities corresponding to the body 11, first lid 12, and optionally the second lid 13 of the snus container. A nozzle 1014 guides material into the mould cavities. Once the snus container 1 has solidified, the snus container 1 is ejected by ejection pins 1024. Preferably, the material used is a plastic or polymer material. Here, parts of the snus container 1 includes a body 11 defining a first compartment and a first lid 12 adapted to be releasably attached to the body 11 to close the first compartment. Parts may also include a second lid 13 adapted to be releasably attached to the first lid 12 to close a second compartment defined by the first lid 12. The body 11, the first lid 12 and the optional second lid 13 may be provided in accordance with any of the embodiments or contemplated variations previously discussed.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A snus container, comprising:

a body defining a first compartment;

a first lid adapted to be releasably attached to the body to close the first compartment;

the snus container further comprising a locking arrangement comprising a first latch member and a second latch member, wherein the first latch member is arranged to a lid side portion of the first lid and the second latch member is arranged to a body side portion of the body, wherein the first lid is adapted to be rotatable relative the body about a rotational axis between a first closed position where the first latch member and the second latch member are latched together to axially fix the first lid to the body, and an unlocked position where the first lid is axially displaced relative its first closed position, wherein the locking arrangement is adapted to counteract rotation of the first lid from the first closed position towards the unlocked position until the first lid is rotated to a position where the first latch member is forced to axially dislodge from the second latch member, thereby allowing the first lid to freely rotate to the unlocked position and be releasable from the body, wherein one of the body and the first lid comprises a gripping space edge adapted in shape and size to form a gripping space between the gripping space edge and a surface of the other of the body and the first lid, wherein said gripping space edge is in a position to prevent access to said gripping space when the first lid is in the first closed position and in a position to allow access to said gripping space when the first lid is in the unlocked position, and further wherein the first lid is adapted to be rotatable relative the body about the rotational axis between the first closed position and a second closed position, and wherein the locking arrangement is configured to retain the first lid axially fixed to the body during rotation between the first closed position and the second closed position.

2. Snus container according to claim 1, wherein one of the body and the first lid comprises an engagement element adapted to engage with at least one sloping edge portion provided by the other of the body and the first lid so that when the first lid rotates relative the body from the first closed position to the unlocked position, the engagement element slides along said at least one sloping edge portion, thereby forcing the first lid to displace relative its first closed position so that the first latch member axially dislodges from the second latch member.

3. Snus container according to claim 2, comprising at least one pair of sloping edge portions arranged proximate to each other to form a respective ridge, wherein one ridge comprises a plateau arranged between the sloping edge portions of said ridge.

4. Snus container according to claim 1, wherein one of the body and the first lid is made of a first material, and the other of the body and the first lid is made of a second material different from the first material.

5. Snus container according to claim 1, wherein one of the first latch member and the second latch member is a protrusion and the other of the first latch member and the second latch member is a recess adapted in shape and size to receive said protrusion.

6. Snus container according to claim 5, the locking arrangement is adapted to provide a first interface between the first latch element and the second latch element which is acutely angled relative a rotational plane of the snus container.

7. Snus container according to claim 1, wherein the first lid defines a second compartment, wherein the snus container further comprises a second lid adapted to be releasably attached to the first lid to close the second compartment.

8. A mould is adapted in shape and size to define a plurality of cavities corresponding to at least the body and the first lid of the snus container according to claim 1.

9. A method for releasing a first lid from a body of a snus container, the method comprising the steps of:

rotating the first lid relative to the body from a first closed position to a second closed position during which a first latch member remains engaged with a second latch member, wherein the body comprises the first latch member and the first lid comprises the second latch member;

rotating the first lid relative the body from the second closed position, and engaging an engagement element with a sloping edge portion, disengaging the first latch member from the second latch member, further rotating the first lid relative the body into an unlocked position.

10. The method according to claim 9, wherein the body comprises the sloping edge portion and the first lid comprises the engagement element.

11. The method according to claim 9, wherein the step of engaging the engagement element with the sloping edge portion comprises sliding the engagement element onto the sloping edge portion.

12. The method according to claim 9, wherein the sloping edge portion is a portion of a ridge.

13. The method according to claim 9, wherein the step of disengaging the first latch member and the second latch member comprises that the first latch member and the second latch member are axially dislodged from each other.

14. The method according to claim 9, wherein the step of rotating the first lid relative the body into the unlocked position comprises sliding the engagement element onto a plateau of the ridge.

15. The method according to claim 9, wherein a step precedes the step of rotating, the step comprises:

rotate the first lid relative the body from a second closed position into the first closed position, wherein the first lid remains axially fixed to the body.

* * * * *